United States Patent [19]

Lumpp et al.

[11] Patent Number: 4,906,818

[45] Date of Patent: Mar. 6, 1990

[54] HEATER SAFETY MECHANISM

[75] Inventors: Charles H. Lumpp; William W. Wolkoff, both of Columbia, Mo.

[73] Assignee: Toastmaster, Inc., Columbia, Mo.

[21] Appl. No.: 206,493

[22] Filed: Jun. 14, 1988

[51] Int. Cl.[4] ..... H01H 9/20

[52] U.S. Cl. ..... 219/364; 200/61.41; 200/61.42; 200/334; 200/573; 219/346; 219/481; 219/518

[58] Field of Search ..... 200/61.41, 61.42, 61.58 R, 200/573, 334, 337; 219/363, 364, 366, 339, 342, 346, 481, 518

[56] References Cited

U.S. PATENT DOCUMENTS

| | | | |
|---|---|---|---|
| 2,403,163 | 7/1946 | Ziegler | 219/383 |
| 3,175,059 | 3/1965 | Chesnut | 219/364 |
| 3,643,346 | 2/1972 | Lester | 219/366 |
| 3,755,642 | 8/1973 | Warner | 200/332 |
| 4,097,843 | 6/1978 | Basile | 200/51.1 |
| 4,356,369 | 10/1928 | Hostetler et al. | 200/334 |
| 4,358,651 | 11/1982 | Hostetler et al. | 200/334 |
| 4,366,366 | 12/1982 | Ekblad | 219/247 |

*Primary Examiner*—A. D. Pellinen
*Assistant Examiner*—Jeffrey A. Gaffin
*Attorney, Agent, or Firm*—Kokjer, Kircher, Bradley, Wharton, Bowman & Johnson

[57] ABSTRACT

A safety mechanism for disabling a portable room heater. A lever which extends from the heating face of the heater is coupled with a shut-off switch. Movement of the lever resulting from draping of an object over the heater opens the switch and shuts off the heater. A buzzer may be wired in parallel with the switch to provide an audible alarm when the switch opens.

10 Claims, 1 Drawing Sheet

HEATER SAFETY MECHANISM

BACKGROUND OF THE INVENTION

This invention relates in general to heating devices and more particularly to a safety mechanism for a portable room heater.

Portable room heaters are commonly used for providing localized heating to selected areas of a building. The heaters allow the overall temperature of the building to be maintained at a reduced level for energy savings while the desired comfort level in the selected areas is maintained by the heaters.

Portable heaters typically generate radiant energy using either electrical resistance type heating elements or burners fueled by kerosene or other suitable fuels. Because of the operating temperatures achieved by these devices, reasonable care must be exercised when operating the heaters.

Thermal switches have been used as a safety feature with portable heaters to shut off the heater when a temperature buildup is detected as a result of heater malfunction or in situations where an article is draped over the heater. While such switches have proven to be reliable under most conditions of usage, a safety mechanism which does not rely upon a temperature build-up for detecting draping of an article over the heater would be desirable under certain conditions.

SUMMARY OF THE INVENTION

It is a primary object of this invention to provide a portable room heater with a mechanism for detecting draping of material over the face of the heater so that the heater may be shut off before a significant temperature build-up occurs.

It is another object of this invention to provide a shut-off switch coupled with a lever projecting outwardly from the face of the heater so that draping of material over the heater will cause direct movement of the lever and open the switch to quickly shut off the heater before damage to the heater or material occurs.

It is a further object of this invention to provide a switch lever which may be retracted from an operating position projecting outwardly from the face of the heater for detecting draping of the heater to a generally recessed position so that the heater may easily be stored when not in use.

As a corollary to the previous object, it is also an object of this invention to provide a switch lever which prevents operation of the heater when the lever is retracted to the recessed position for storage.

It is a still further object of this invention to provide an alarm buzzer which is wired directly with the shut-off switch so that the added expense of a separate switching mechanism may be avoided.

To accomplish these and related objects of the invention, a heater is provided with a safety switch and a mechanical lever for operating the switch. The lever extends outwardly from the face of the heater and is operably coupled with the switch so that movement of the lever resulting from draping of an object over the heater opens the switch to shut off the heater. An alarm buzzer may be directly coupled with the switch to provide an audible warning when the switch opens. The lever may be moved from its extended operating position to a recessed storage position which also prevents operation of the heater.

BRIEF DESCRIPTION OF THE DRAWINGS

In the accompanying drawings in which like reference numerals are used to indicate like parts in the FIG. 1 s a perspective view of a heater of the present invention.

DESCRIPTION OF THE PREFERRED EMBODIMENT

Figure 1:
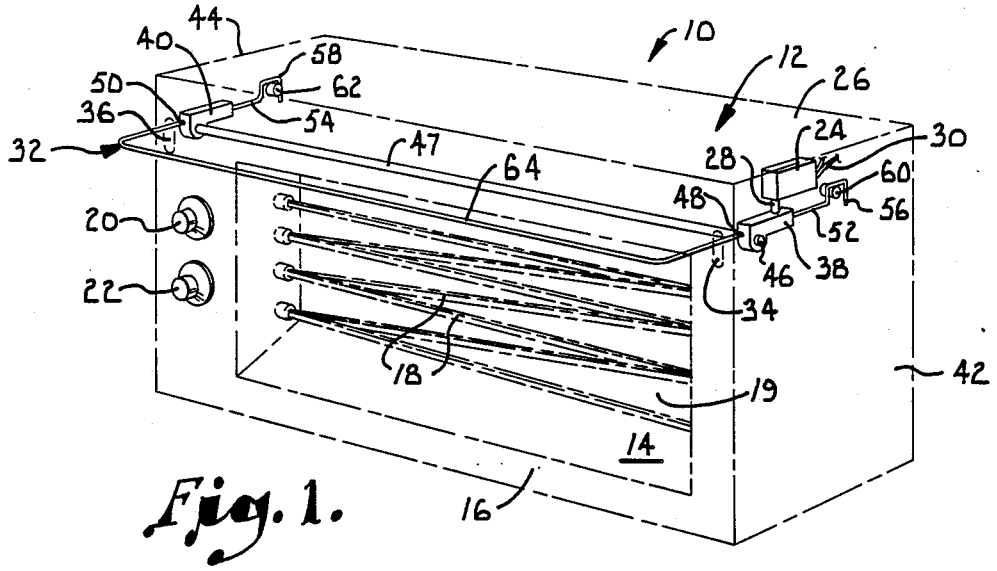

Referring now to the drawings in more detail and initially to FIG. 1, the numeral 10 broadly designates a portable room heater having a generally rectangular cabinet 12. Heater 10 is but one of many types of portable heaters with which the features of this invention may be used. A recessed portion 14 formed in a front face 16 of the cabinet houses a plurality of resistance-type heating elements 18 which are spaced near a back wall 19 of the recessed portion. The back wall 19 may include a refractory lining for reflecting heat outwardly from the wall. Control knobs 20 and 22 are located on the front face 16 of the cabinet and regulate operation of the heater.

Figure 2:
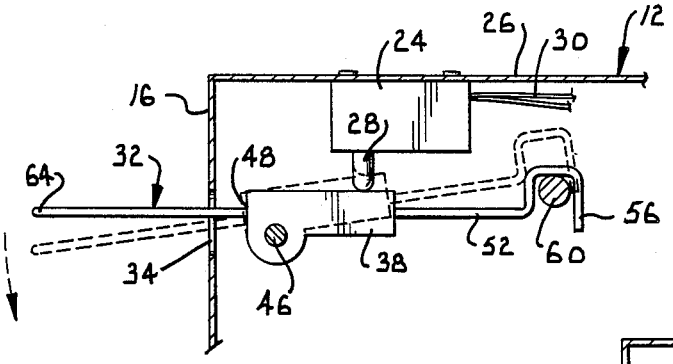
FIG. 2 is a side elevational view of the heater safety mechanism shown in FIG. 1, with broken lines illustrating the pivoting movement of a switch lever.
Figure 3:
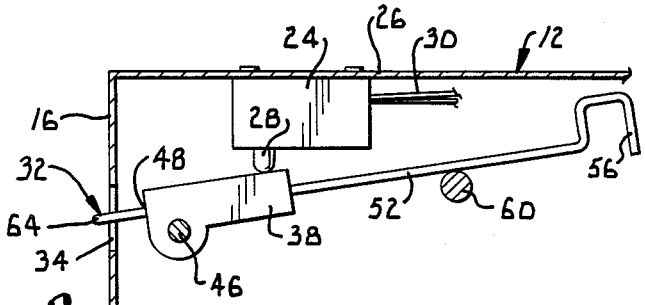
FIG. 3 is a side elevational view similar to that shown in FIG. 2 but with the lever shown in a retracted position.

Referring additionally to FIGS. 2–3, a normally closed switch 24 is internally positioned on an upper wall 26 of the cabinet. Switch 24 includes an extendable and retractable switching element 28 which is biased by a spring or other suitable means to a downwardly extended position. Electrical conductors 30 connect the switch with the control circuitry of the heater in a manner which will be subsequently described.

A switch lever broadly designated by the numeral 32 is positioned in operable engagement with switch 24. Lever 32 is formed into a U-shape and extends into the heater cabinet through laterally spaced elongated openings 34 and 36 in the front face 16 of the cabinet. The lever is pivotally mounted to the cabinet by sleeves 38 and 40 which are each attached to the interior of cabinet end walls 42 and 44 by mounting pin 46. A stabilizing member 47 may be used to connect the sleeves to provide added rigidity to the lever.

The sleeves 38 and 40 include longitudinally extending internal bores 48 and 50 for receiving the inwardly extending rod segments 52 and 54 of the lever. The diameter of bores 48 and 50 is sized slightly larger than the cross-sectional diameter of the lever to allow sliding axial movement of the rod segments within the sleeves. Sleeve 38 is positioned in vertical alignment with switch 24 and preferably has a flat upper surface for contacting the switching element 28. When in the normal operating position shown in FIG. 1, the lever extends generally horizontally and sleeve 38 is in contact with the extended switching element. When the lever pivots downward to the position shown in FIG. 2, the sleeve upper surface moves upward and depresses the switching element 28 to open the switch.

The end portions of rod segments 52 and 54 are formed into generally U-shaped hooks 56 and 58 which open in a downward direction. Pins 60 and 62 are coupled with cabinet end walls 42 and 44 and are positioned for receiving hooks 56 and 58 to maintain the lever 32 at a generally horizontal orientation.

The lever 32 includes a bar portion 64 which connects inwardly projecting segments 52 and 54. The bar is positioned exteriorly of the cabinet and is preferably vertically positioned above the top edge of the recessed portion to at least partially shield the bar from the radiant heat generated by the heating elements 18. The bar may also be formed from materials which do not readily conduct heat so that the bar is not heated to an excessive temperature. The bar portion extends longitudinally a distance sufficient to span the longitudinal dimension of the recessed portion and in the normal operating position the bar is spaced outwardly from the cabinet front face 16. The distance the bar is spaced from the heater face may be varied to suit particular applications.

Figure 4:
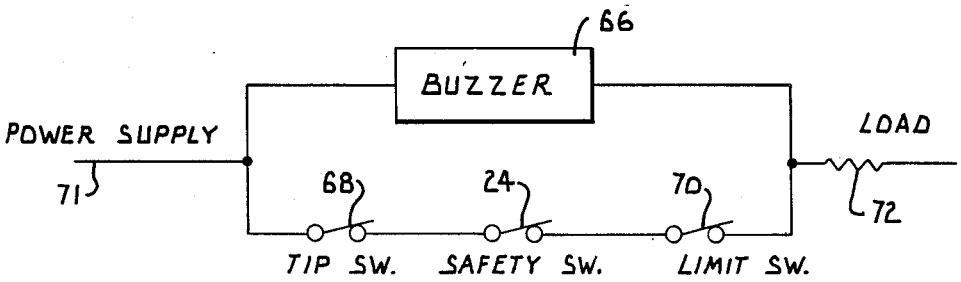
FIG. 4 is a circuit diagram showing the manner in which a safety switch may be wired with an alarm buzzer.

Referring now to FIG. 4, the safety switch may be wired in parallel with an alarm buzzer 66. Other types of switches such as a tip switch 68 and a limit switch 70 may be wired in series with safety switch 24. A power supply 71 and the heater load 72 which generally comprises the heating elements are connected to the buzzer and switches. The voltage drop across the buzzer and the resistance of the load are selected so that the buzzer will operate and the load will be shut off when one of the switches opens.

In use, the switch lever 32 operates as a mechanical sensor for detecting draping of an article over the heater 12. When a downward force is applied to the bar 34 by the weight of the article, the lever pivots about the sleeve mounting pins 46 and causes upward movement of sleeve 38. As sleeve 38 moves upward it depresses the switching element 28 to open the switch 24 and activate the buzzer and shut off the heater. As can be seen in FIG. 4, when any of the switches are opened, current flow to the load is interrupted and is routed to the buzzer which provides an audible warning of a potential safe hazard. By selecting an appropriate voltage drop across the buzzer in relation to the source voltage and the load resistance, the load is shut off upon opening of switch 24. This type of circuit arrangement provides a reliable method for operation of the buzzer and eliminates the expense of using separate switching with a solenoid, relay or double throw switch to operate the buzzer.

The distance of separation between the bar and the heater face 16 should be large enough so that articles draped over the heater will contact and cause downward movement of the lever. To ensure detection of an article draped anywhere along the recessed area, it is important that the bar 64 extend laterally a distance sufficient to span the recessed area. To prevent tampering, the safety switch is preferably positioned internally of the heater cabinet 12.

The use of lever 32 is cooperation with switch 24 provides a dependable method for promptly shutting off the heater when an article is draped over the heater. The lever provides a substantially instantaneous means for detecting the draping of the heater so that the heater may be promptly shut off. The projecting lever also has the added benefit of ensuring at least a minimum spacing between the heater face and furniture or other items within the room.

When desired, the lever may be retracted to a storage position as shown in FIG. 3 by first tilting the bar downward so that the hooks 56 and 58 disengage pins 60 and 62 and then sliding the lever inwardly so that the bar portion 64 is brought into contact with the cabinet front face. The retractability of the lever is an important feature as it might otherwise be damaged during transportation and would also require a significant increase in storage space if maintained in an extended position. In addition, retraction of the lever provides an added safety benefit by bringing sleeve 38 into contact with switching element 28 to open the switch 24 and prevent inadvertent operation of the heater.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, what is claimed is:

1. A portable heater comprising:

a housing structure;

means for emitting heat from a face of said structure;

a switch coupled with said heat emitting means and movable from a normally closed position to an open position to disable said heat emitting means; and a mechanical lever extending from said structure to detect draping of an article across the heat emitting face, said lever being operably coupled with said switch and being movable between a retracted storage position adjacent said face and an extended operating position spaced outwardly from said face, wherein said switch is moved to the open position when the lever is in the retracted storage position, whereby said heat emitting means is disabled when the lever is in the retracted storage position, said lever being operable when in said extended operating position to move said switch to the open position and disable said heat emitting means, whereby said lever is operable to detect draping of an article across the face of the housing structure.

2. The invention of claim 1, including an alarm coupled with the switch for providing an audible warning upon movement of said switch to the open position.

3. The invention of claim 2, wherein said alarm is wired in parallel with said switch.

4. The invention of claim 1, wherein said lever includes a bar portion which extends substantially across said heat emitting face, whereby said bar portion is spaced outwardly from the heat emitting face when the lever is in the extended operating position and is positioned adjacent the heat emitting face when the lever is in the retracted storage position.

5. The invention of claim 4, including means coupled with said structure to permit pivoting of said lever upon application of a downward force to said bar.

6. A portable heater comprising:

a housing structure;

means for emitting heat from a face of said structure;

a switch coupled with said heat emitting means said movable from a normally closed position to an open position to disable said heat emitting means; and a mechanical lever extending from said structure to detect draping of an article across the heat emitting face, said lever being operably coupled with said switch and being movable between a retracted storage position and an extended operating position, said lever including a bar portion which extends substantially across said heat emitting face, wherein said bar portion is spaced outwardly from the heat emitting face when the lever is in the extended operating position and is positioned adjacent the heat emitting face when the lever is in the retracted storage position, said lever being operable when in said extended operating position to move said switch to the open position and disable said heat emitting means, whereby said lever is operable to detect draping of an article across the face of the housing structure.

7. The invention of claim 6, wherein said switch is moved to the open position when the lever is in the retracted storage position, whereby said heat emitting means is disabled when the lever is in the retracted storage position.

8. The invention of claim 7, including an alarm coupled with the switch for providing an audible warning upon movement of said switch to the open position.

9. The invention of claim 8, wherein said alarm is wired in parallel with said switch.

10. The invention of claim 9, including means coupled with said structure to permit pivoting of said lever upon application of a downward force to said bar.

* * * * *